US006260242B1

(12) United States Patent
Fildan et al.

(10) Patent No.: US 6,260,242 B1
(45) Date of Patent: Jul. 17, 2001

(54) REVERSIBLE PRESS BUTTON GARMENT CLOSURE

(75) Inventors: Gerhard Fildan, Vienna; Karl Wanzenböck, Leobersdorf, both of (AT)

(73) Assignee: Fildan Accessories Corporation, Englewood, NJ (US)

( * ) Notice: Subject to any disclaimer, the term of this patent is extended or adjusted under 35 U.S.C. 154(b) by 0 days.

(21) Appl. No.: 09/540,339

(22) Filed: Mar. 31, 2000

(51) Int. Cl.[7] ..... A44B 11/00; A44B 21/00
(52) U.S. Cl. ..... 24/329; 24/682.1; 24/662; 450/58
(58) Field of Search ..... 24/329, 580, 590, 24/591, 614, 615, 662, 682.1, 114.4; 450/58, 78, 82; 2/235, 265, 270, 322

(56) References Cited

U.S. PATENT DOCUMENTS

| | | | | |
|---|---|---|---|---|
| 3,200,464 | * | 8/1965 | Cousins | 24/682.1 X |
| 3,979,801 | * | 9/1976 | Tareau | 24/580 X |
| 4,000,544 | * | 1/1977 | Fildan | 24/590 |
| 4,161,806 | * | 7/1979 | Hennisse et al. | 24/580 |
| 5,377,394 | * | 1/1995 | Fildan | 24/590 X |
| 5,427,562 | * | 6/1995 | Kwang | 450/58 |
| 5,784,765 | * | 7/1998 | Fildan | 24/615 |
| 6,009,604 | * | 1/2000 | Fildan | 24/662 |

* cited by examiner

*Primary Examiner*—Robert Sandy
(74) *Attorney, Agent, or Firm*—Herbert Dubno

(57) ABSTRACT

A reversible press button closure for shoulder straps of brassieres or back band connectors has soft attachment pieces secured to the garment and connected by pins and lugs with male and female ring members which are molded from a harder plastic and define the press button assembly. The male and female members match in appearance when they are interconnected so that the connector has the same appearance from both sides.

16 Claims, 9 Drawing Sheets

FIG. 3
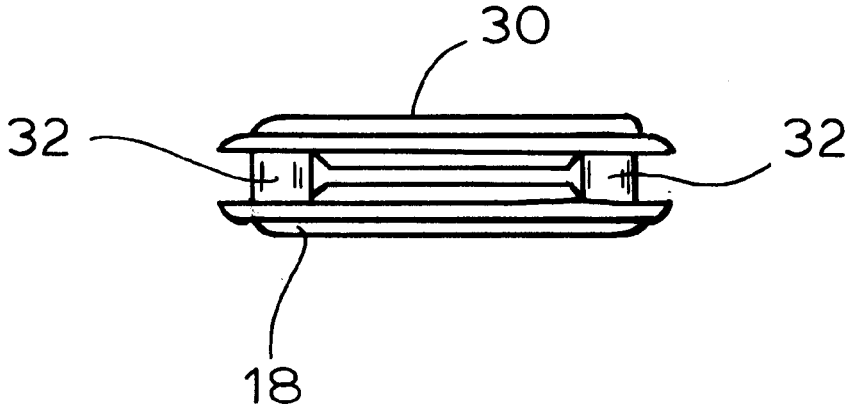
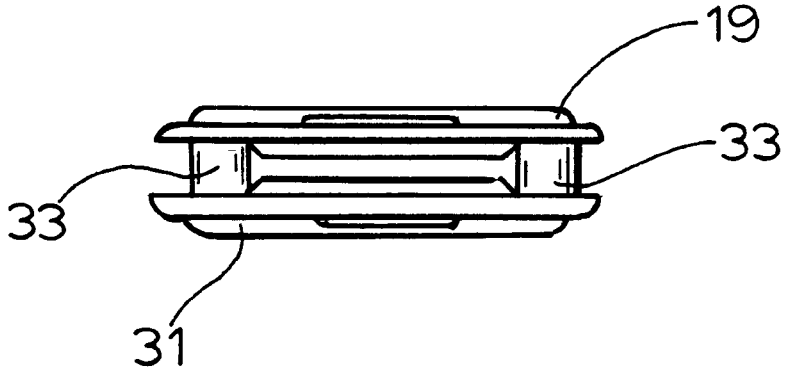
FIG. 4

REVERSIBLE PRESS BUTTON GARMENT CLOSURE

FIELD OF THE INVENTION

The present invention relates to a reversible press button garment closure which can be used as a garment closure for the back band, for example, of a brassiere or for a shoulder strap of a brassiere or, in general, for interconnecting any two garment parts, especially in cases in which at least one of the parts is a strap or band and most particularly for lingerie, swim suits, brassieres and the like.

BACKGROUND OF THE INVENTION

While there are many closure devices which are used in brassieres, undergarments, lingerie, swim suits and the like to connect two parts of the garment and enable them to be released and reengaged, e.g. the back closure of a brassiere or a shoulder strap thereof, in most instances the closure involves some form of hook and eye engagement. While press button type closures are also known, by and large these are difficult to attach, difficult to use and frequently cannot be reversible, i.e. do not have the same general appearance when seen from opposite sides.

In many garment closure applications, reversibility is an important consideration. Other important considerations for such closures are the ability to take up considerable tensile stress, an ability to be laundered without damage to the fastener or other garments or the garments provide with the fastener itself, ease of manipulation and esthetic appearance.

OBJECTS OF THE INVENTION

It is, therefore, the principal object of the present invention to provide an improved reversible press button fastener, especially for use as the back closure of a brassiere or a shoulder strap closure of a brassiere which will satisfy the requirements outlined above and which nevertheless is free from drawbacks of earlier closures and can, in addition, be used in other garment applications.

Another object of the invention is to provide a garment closure which can be applied to the garment parts to be connected thereby in a versatile and convenient manner, which does little or no damage upon laundering of the garment, has an esthetic appearance, is easily manipulated (opened and closed) and is reversible in the sense it has similar appearances from opposite sides.

SUMMARY OF THE INVENTION

These objects and others which are attained in accordance with the invention in a press button closure which comprises:

- a female closure member in the form of a first ring having a hole and a first lug projecting laterally of the first ring;
- a male closure member in the form of a second ring externally matching the first ring, a boss press-fittingly receivable in the hole, and a second lug projecting laterally of the second ring, the closure members being formed from relatively hard plastic; and
- respective attachment pieces of relatively soft plastic connected to the lugs and securing each of the members to a part of a garment.

According to a feature of the invention, as of the attachment pieces comprises pair of shield-shaped elements interconnected by posts and straddling the respective part of the garment, i.e. the band. or strap parts to which it is secured, and connected to a respective one of the lugs.

Each of the lugs can have a formation mating with a complementary formation in one of the shield-shaped elements and preferably the formations are pins and holes with each lug having a row of three pins of each side of the lug and engaging in three holes in a row in the shield element on the respective side. The shield elements are then press fitted onto the lugs and a permanent bond can be provided by welding the shield elements and the pins of the lugs together.

The fastener can, however, be separable by pulling apart the shield-shaped members and the ring member where a permanent weld is not made.

According to an important feature of the invention, the rings and the shield-shaped members are of different colors and the shield-shaped members can be somewhat translucent to enable at least the outlines of the lug to be visible beneath the shield-shaped element. The ring, lug and pins may be of a different color and since the pins have their ends exposed through the shield-shaped member, the row of pin ends in each shield-shaped member may contribute a design or esthetic feature to the closure.

According to a feature of the invention, one of the shield-shaped elements is formed with the pair of posts while the other shield-shaped element is provided with a pair of holes receiving those posts.

Parts of a back band of the brassiere may be secured beyond the shield-shaped elements of each attachment piece or the attachment pieces may be mounted on parts of a shoulder strap of a brassiere or like garment.

An important feature of the invention is that the two rings have matching outer parts and, especially outwardly convex curved cross sections which match in appearance. The male member can be a tubular boss which is received in the hole of the other ring and since the edge of that boss is visible from the outer side of the female member, a similar rim can be provided along the inner periphery of the male ring. Both the male and female members may have planar surfaces at which they interengage when the members are interconnected.

An important feature of the invention is that the attachment pieces, i.e. the shield-shaped elements, can be molded from relatively soft and flexible synthetic resin material whereas the rings can be molded from rigid synthetic resin material. The resulting closure is thus highly flexible where it is connected to the garment but rigid where the press button parts, i.e. the two rings, interconnect.

BRIEF DESCRIPTION OF THE DRAWING

The above and other objects, features, and advantages will become more readily apparent from the following description, reference being made to the accompanying drawing in which:

FIG. 3 is a top view of the closure;

FIG. 4 is a bottom view of the closure;

SUMMARY OF THE INVENTION

Figure 1:
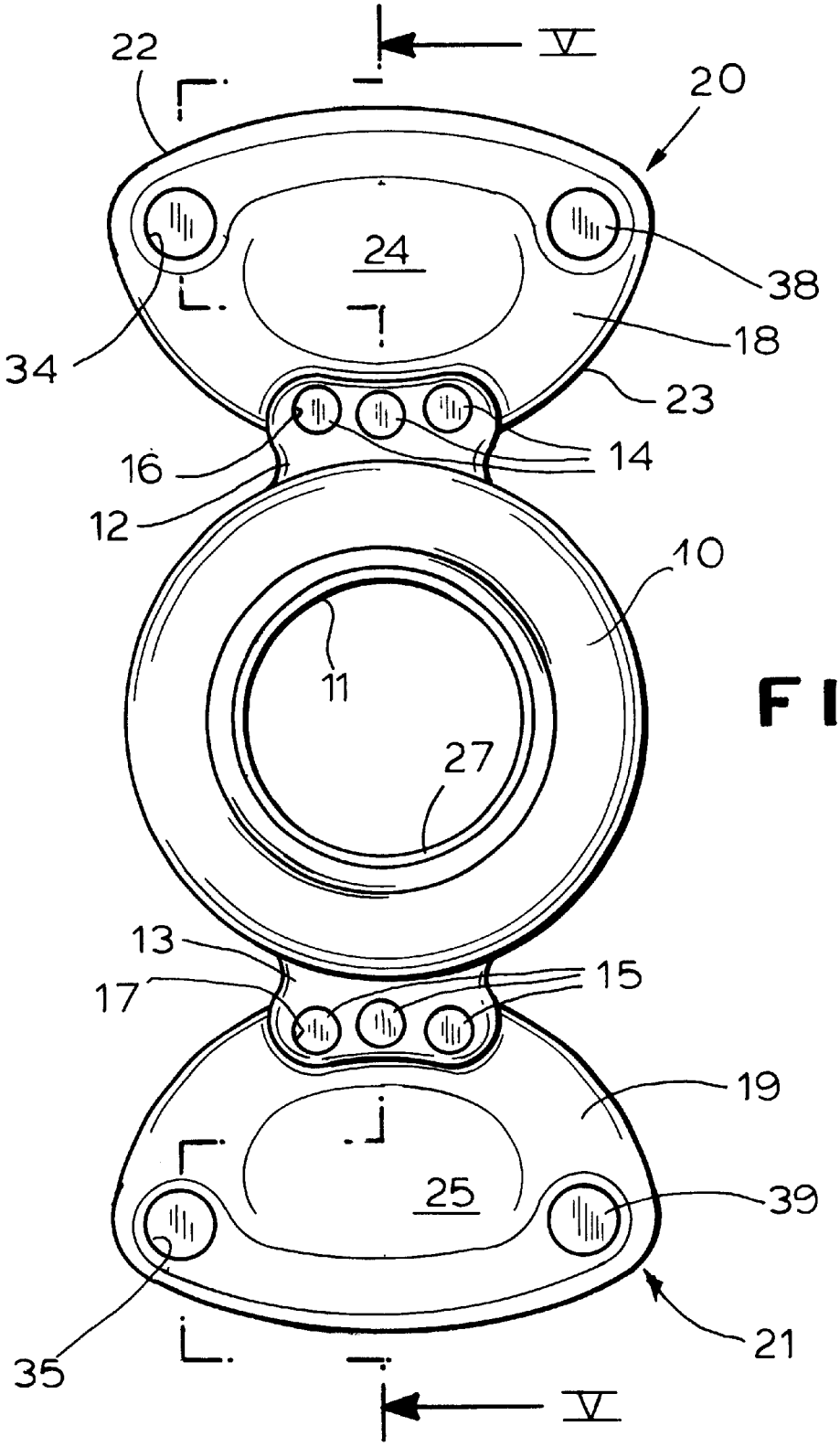
FIG. 1 is a front elevational view of a reversible closure illustrating the present invention.

The basic structure of a reversible push button connector, according to the invention, comprises a female ring member 10 and a male ring member 11, fitted together and provided with respective lugs 12 and 13 which, in the connector illustrated, each have three pins 14 and 15 on each side of the respective lug to engage in holes 16 and 17 of respective shield-shaped members 18 and 19 forming attachment pieces 20 and 21, respectively, attach to respective parts of the garment.

As can be seen from FIG. 1, the shields 18 and 19 each are composed of a relatively soft injection molded synthetic resin which is somewhat translucent so that the outline of the respective lug 12, 13 can be seen throughout. The shields 18 and 19 are of rather shallow curvature at 22 and have a curvature 23 of a lesser radius or curvature to impart the shield shape. The shields 18 and 19 also bulge outwardly at their center portions 24 and 25 as is visible in FIG. 1.

Figure 2:
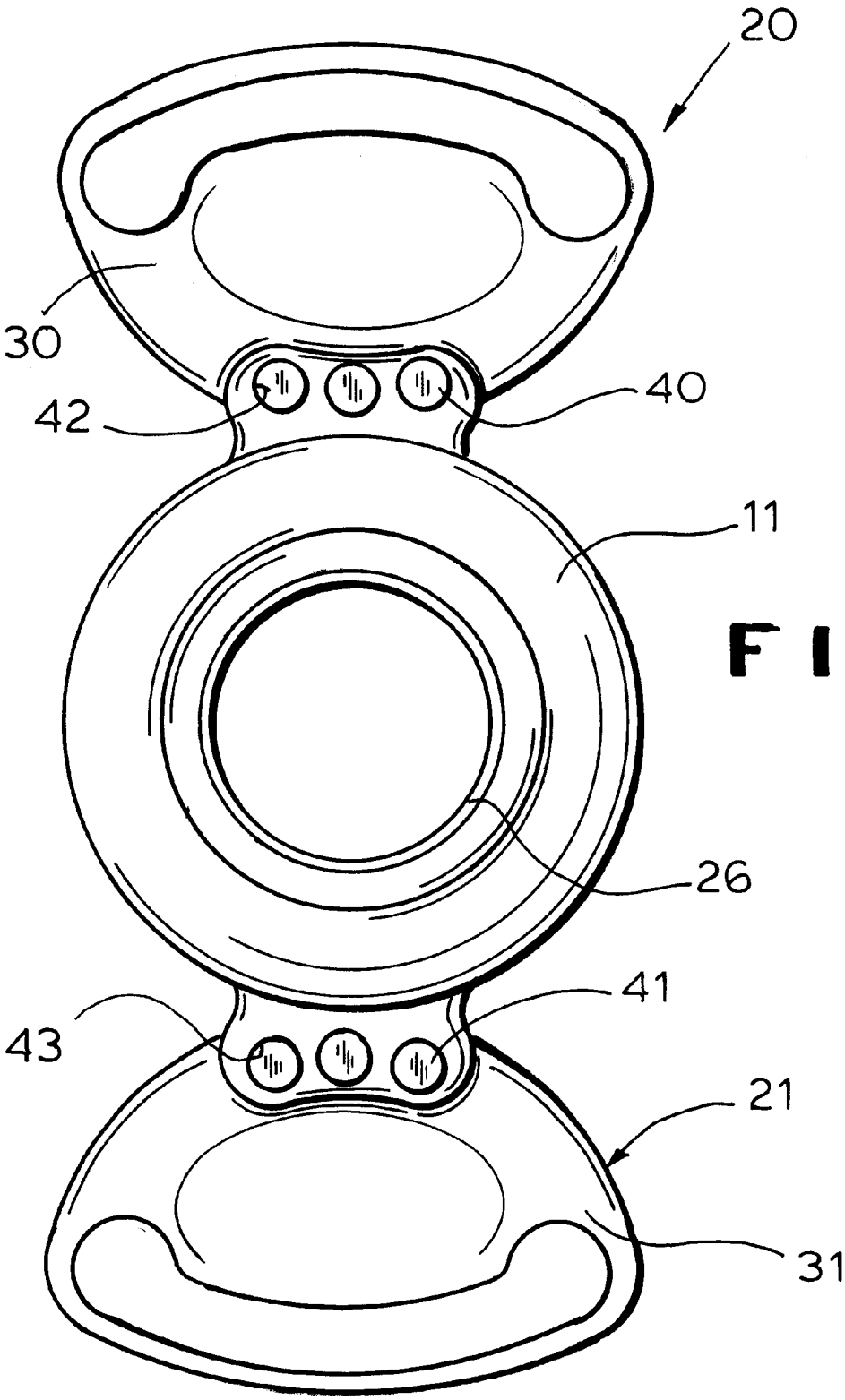
FIG. 2 is a rear elevational view thereof.

The male ring member 11, as can be seen in FIG. 2, has an outer contour seen by the viewer which provides a rim 26 corresponding to the end 27 of a boss 28 molded as part of the ring 11 and as will be described in greater deemed hereinafter.

As is also visible from FIG. 2 the attachment pieces 20 and 21 have shield-shaped members 30 and 31 which are similar in construction to the members 18 and 19, except that the shield members 30 and 31 each have a pair of pins 32, 33 which project into holes 34 and 35 of the members 18 and 19, respectively. Members 32 and 33 thus from posts whose ends are visible at 38 and 39 in FIG. 1.

Figure 5:
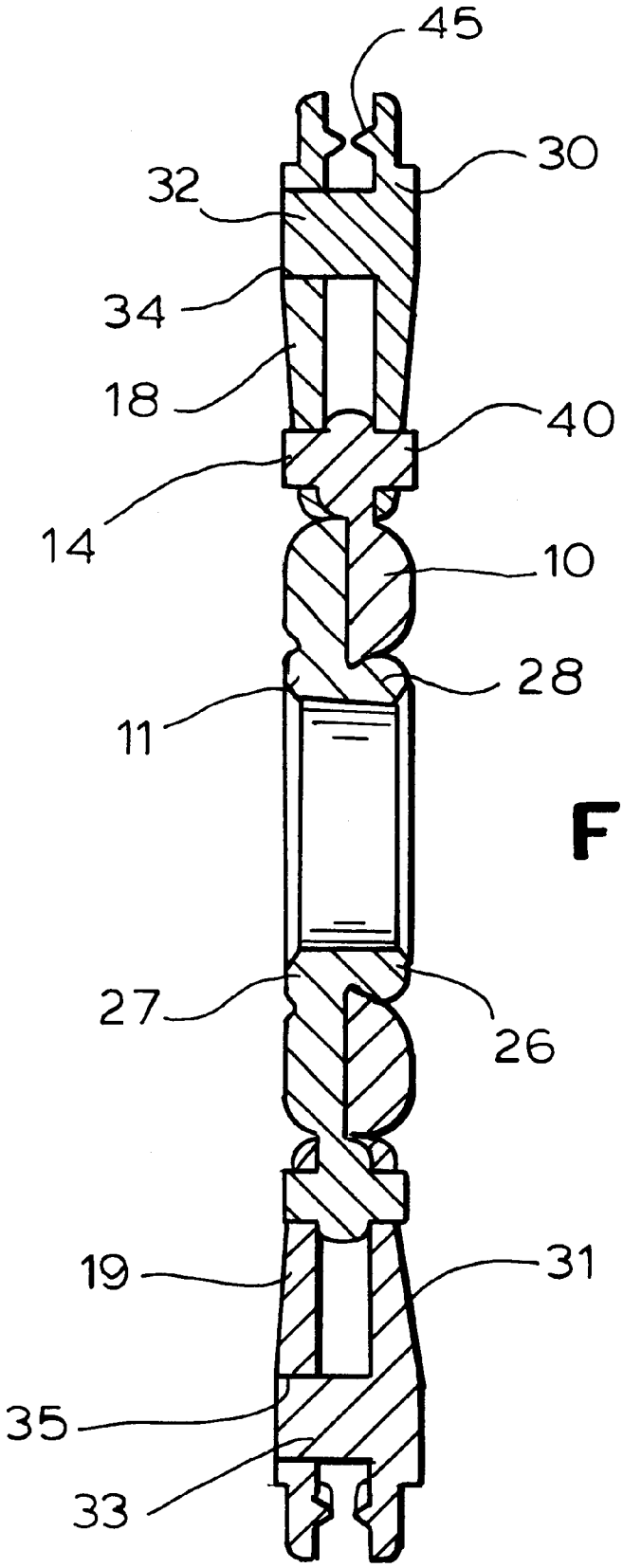
FIG. 5 is a cross sectional view taken along the line V—V of FIG. 1.
Figure 6:
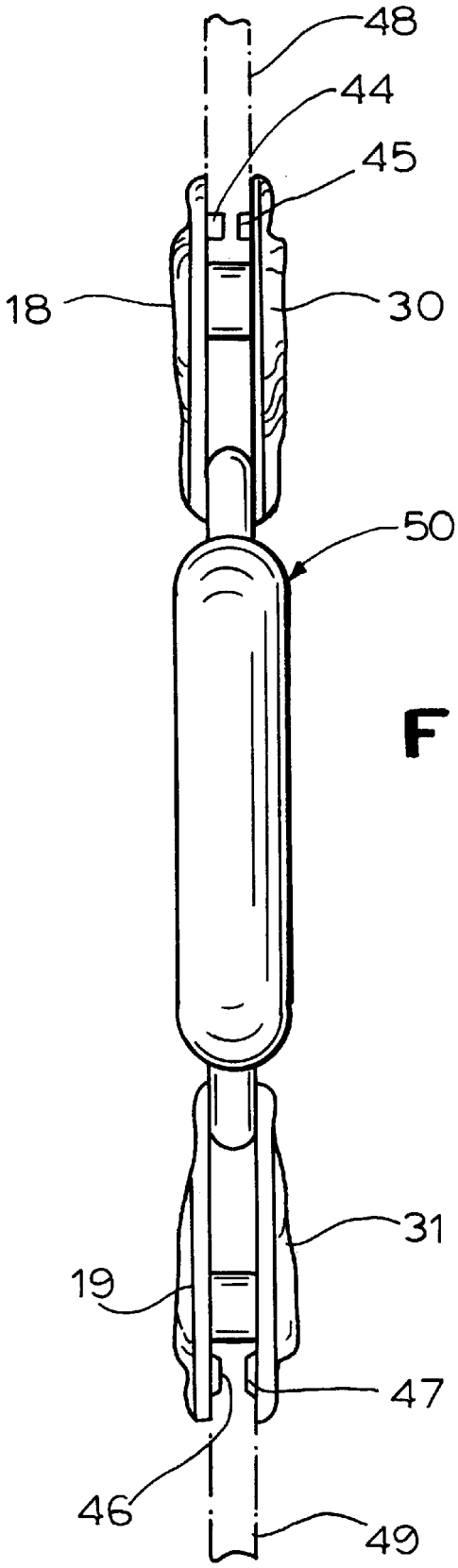
FIG. 6 is a side elevational view of the closure with the garment portion shown in dot-dash lines.
Figure 10:
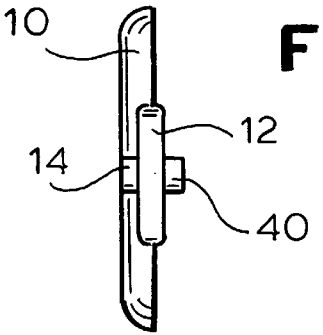
FIG. 10 is a top view of the female ring.
Figure 9:
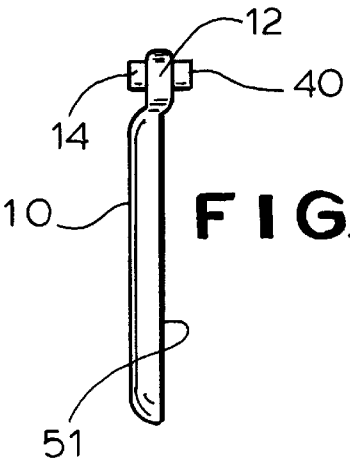
FIG. 9 is a right side elevational view of the female ring.
Figure 8:
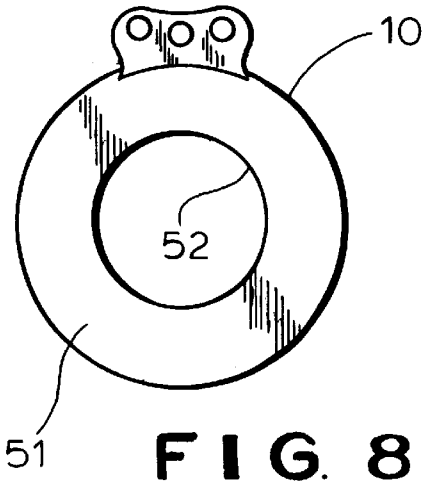
FIG. 8 is an elevational view from an opposite side of the female ring.
Figure 11:
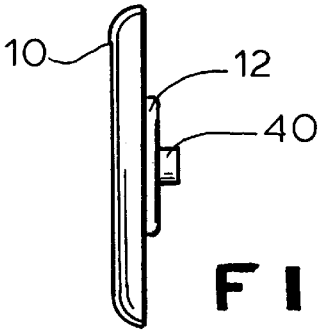
FIG. 11 is a bottom view of the female ring.
Figure 7:
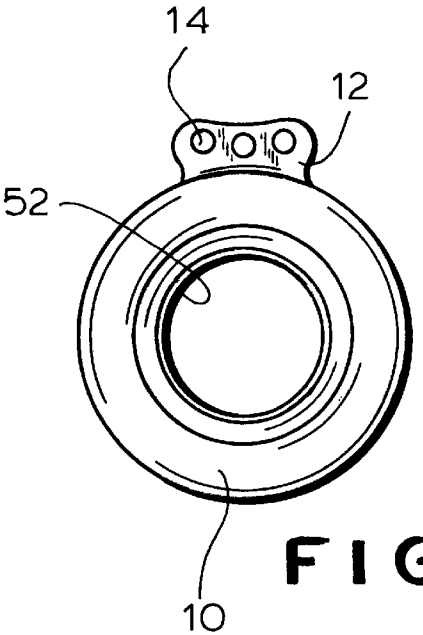
FIG. 7 is an elevational view from an opposite side of the female ring.
Figure 13:
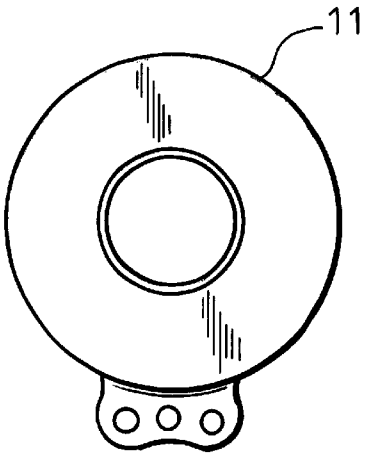
FIG. 13 is a view from the opposite side of the male ring.
Figure 15:
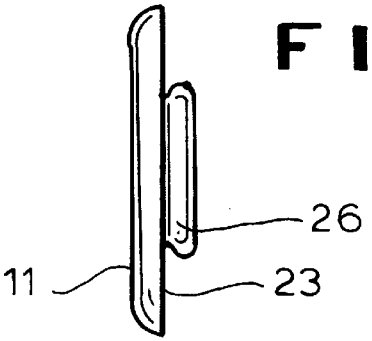
FIG. 15 is a top view of the male ring.
Figure 14:
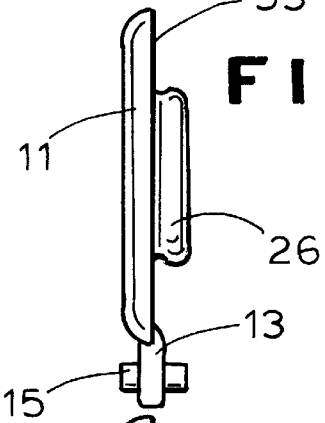
FIG. 14 is a right side elevational view of the male ring.
Figure 16:
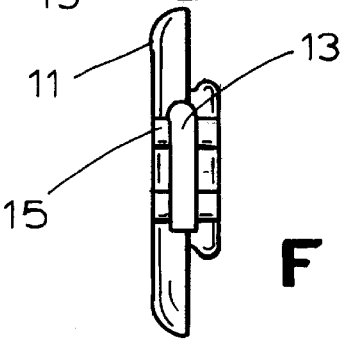
FIG. 16 is a bottom view of the male ring.
Figure 12:
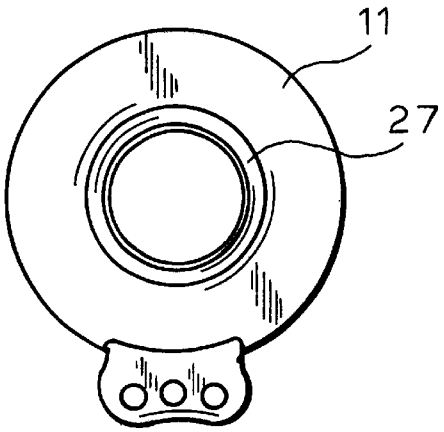
FIG. 12 is an elevational view from one side of the male ring showing a similar contour to the view of FIG. 7.
Figure 18:
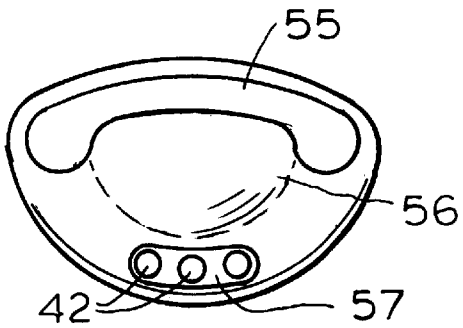
FIG. 18 is an elevational view of this shield element from the opposite side.
Figure 20:
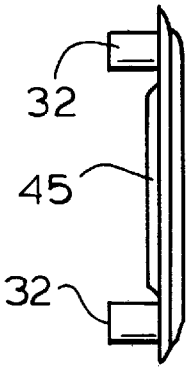
FIG. 20 is a top view of FIG. 17.
Figure 19:
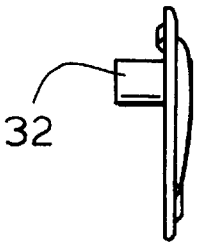
FIG. 19 is a right side elevational view of this shield element.
Figure 21:
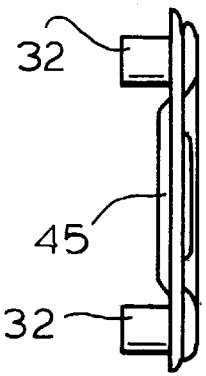
FIG. 21 is a bottom view.
Figure 17:
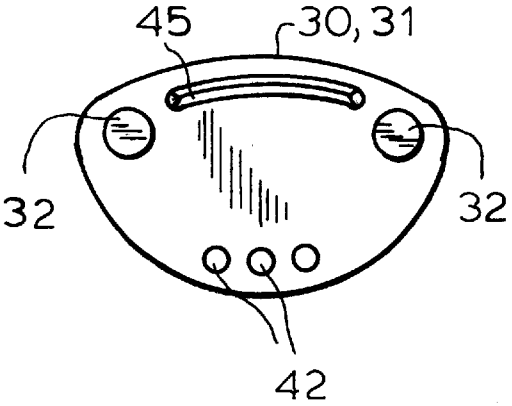
FIG. 17 is an elevational view from one side of the shield element provided with the posts.
Figure 23:
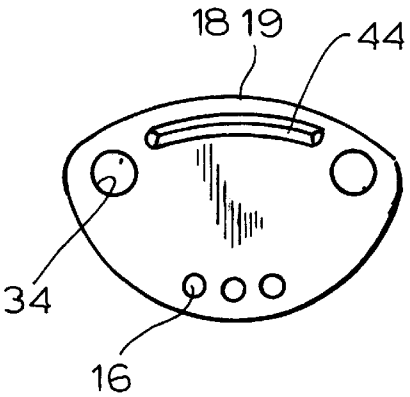
FIG. 23 is an elevational view of this shield element from the opposite side.
Figure 25:
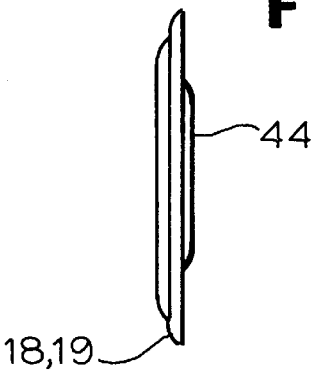
FIG. 25 is a top view thereof.
Figure 24:
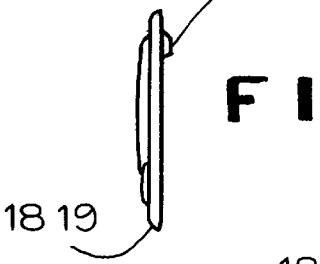
FIG. 24 is a right side elevational view of the element of FIGS. 22 and 23.
Figure 26:
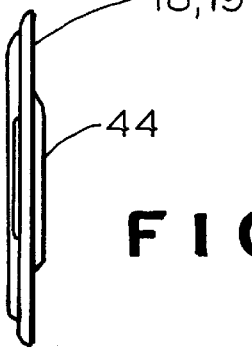
FIG. 26 is a bottom view of this shield element.
Figure 22:
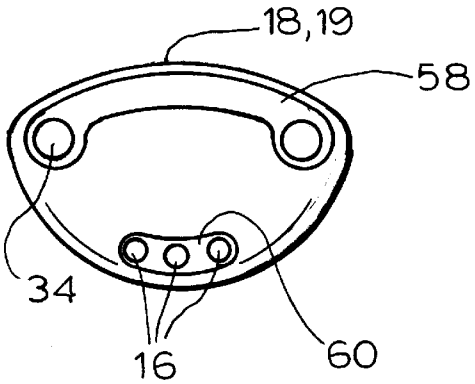
FIG. 22 is an elevational view from an outer side of the other shield element of each attachment piece.

The pins 40 and 41 on the lugs 12 and 13 project into holes 42 and 43 of the shield-shaped elements 30 and 31. As will be apparent from FIGS. 5 and 6, in addition, members 18 and 30 have formations or teeth 44 and 45 while the members 19 and 31 have corresponding teeth 46 and 47 which bite into the fabrication 48, 49 of the garment pieces to which the push button closure is attached so that clamping of the shield members together and optionally welding pin or posts will lock the attachment pieces 20 and 21 onto the pieces of fabric. From FIGS. 7 through 11, the female ring 10 can be seen in greater detail.

The female member 10 has a hole 52 attached to accommodate the boss 26 and form a contour as has been described in connection with FIGS. 1 and 2 at 27. It is rounded and of convex curvature outwardly as can be seen from FIGS. 1, 2, 6 and 9 through 11. The boss can be pressed into the hole to form the press button therewith.

The boss 26 (FIGS. 12 through 16) is cylindrical and formed on the inside of the male member 11. The male member 11 has a planar annular surface 53 surrounding the boss 26 and the lug 13 lies in the plane of this surface. Similarly, surrounding the hole 52 is a planar surface 51 of the female member 10. The lug 12 lies in the plane of the surface 51.

On its exterior surface, the male member 11 is provided with the rim like formation 27 which mimics the end of the boss 26.

As will be apparent from FIGS. 7 to 16, when the boss 26 is snapped into the hole 52 the press button is engaged when the snap is closed and when the members 10 and 11 are pulled apart, the closure is disengaged. The members 10 and 11 are composed of injection molded plastic which is harder than that of the attachment pieces 20 and 21.

These members can be pressed together to form the press button 50. The shield elements of the attachment pieces have been shown in greater detail in FIGS. 17 through 26. In FIGS. 17 through 21, a shield elements of the type shown at 30 and 31 has been illustrated. On its inner side, the shield element is provided with the tooth formation 45 and the posts 32 together with a row of holes 42 as described. On its opposite side, only a kidney shaped land 55 externally of the bulge 56 can be seen. The holes 42 may open at a land 57 (FIG. 18) conversely, the shield members 18, 19 can have a land 58 at which the holes 34 opened and a land 60 at which the holes 16 open. On the opposite side of the member 18, 19, the tooth 44 is provided.

What is claimed is:

1. A press-button garment closure comprising:

a female closure member in the form of a first ring having a hole and a first lug projecting laterally of the first ring;

a male closure member in the form of a second ring externally matching the first ring, a boss press-fittingly receivable in said hole, and a second lug projecting laterally of the second ring, said closure members being formed from relatively hard plastic; and respective attachment pieces of relatively soft plastic connected to said lugs and securing each of said members to a part of a garment.

2. The press-button garment closure defined in claim 1 wherein each of said attachment pieces comprises a pair of shield-shaped elements interconnected by posts, straddling the respective part of the garment and connected to a respective one of said lugs.

3. The press-button garment closure defined in claim 2 wherein each of said lugs has a formation mating with a complementary formation in one of said elements.

4. The press-button garment closure defined in claim 3 wherein said formations are pins and holes.

5. The press-button garment closure defined in claim 4 wherein each of said lugs has a plurality of pins projecting from opposite sides thereof and each of said elements has a plurality of holes receiving the pins on a respective side of the respective lug.

6. The press-button garment closure defined in claim 5 wherein the elements of a respective pair are interconnected by posts formed on one element of the respective pair and engaging in holes of the other element of the respective pair.

7. The press-button garment closure defined in claim 1 wherein said members are of one color and said attachment pieces are of another color.

8. The press-button garment closure defined in claim 1 wherein parts of a bask band of a brassiere are secured to said attachment pieces.

9. The press-button garment closure defined in claim 1 wherein parts of a shoulder strap of a brassiere are secured to said attachment pieces.

10. The press-button garment closure defined in claim 1 wherein matching outer parts of said first and second rings have outwardly convex curved cross sections.

11. The press-button garment closure defined in claim 10 wherein said first ring has a planar inner surface abutting a planar surface of said second ring surrounding said boss.

12. The press-button garment closure defined in claim 11 wherein said boss is tubular.

13. The press-button garment closure defined in claim 12 wherein each of said attachment pieces comprises a pair of shield-shaped elements interconnected by two posts, straddling the respective part of the garment and connected to a respective one of said lugs.

14. The press-button garment closure defined in claim 13 wherein each of said lugs has three pins in a row projecting from each side of the lug and engaging in three holes of a respective one of said elements.

15. The press-button garment closure defined in claim 14 wherein the elements of a respective pair are interconnected by posts formed on one element of the respective pair and engaging in holes of the other element of the respective pair.

16. The press-button garment closure defined in claim 15 wherein said members are of one color and said attachment pieces are of another color.

* * * * *